US008512093B2

(12) United States Patent
Chang

(10) Patent No.: US 8,512,093 B2
(45) Date of Patent: Aug. 20, 2013

(54) INVISIBLE BRA

(76) Inventor: Ju-Chung Chang, Taichung (TW)

( * ) Notice: Subject to any disclaimer, the term of this patent is extended or adjusted under 35 U.S.C. 154(b) by 14 days.

(21) Appl. No.: 13/341,781

(22) Filed: Dec. 30, 2011

(65) Prior Publication Data

US 2013/0095729 A1 Apr. 18, 2013

(30) Foreign Application Priority Data

Oct. 17, 2011 (TW) ..... 100137536 A

(51) Int. Cl.
*A41C 3/00* (2006.01)

(52) U.S. Cl.
USPC ..... 450/81; 450/54

(58) Field of Classification Search
USPC ..... 450/81, 38, 54–58
See application file for complete search history.

(56) References Cited

U.S. PATENT DOCUMENTS 6,231,424 B1 * 5/2001 Valentin ..... 450/81
6,257,951 B1 * 7/2001 DeMarco ..... 450/55
6,257,952 B1 * 7/2001 Valentin ..... 450/81
6,383,055 B2 * 5/2002 Valentin ..... 450/81
6,397,391 B2 * 6/2002 DeMarco ..... 2/88
6,645,042 B2 * 11/2003 Davis ..... 450/88
6,758,720 B2 * 7/2004 Chen ..... 450/57
6,780,081 B2 * 8/2004 Chen et al. ..... 450/81
6,814,648 B2 * 11/2004 Chong ..... 450/81
6,857,935 B1 * 2/2005 Dohan ..... 450/81
6,916,224 B2 * 7/2005 Chen et al. ..... 450/57
7,052,359 B2 * 5/2006 Chen et al. ..... 450/54
7,163,433 B2 * 1/2007 Chou ..... 450/81
7,229,335 B2 * 6/2007 Davis ..... 450/81
7,335,086 B1 * 2/2008 Karon et al. ..... 450/81
7,407,429 B2 * 8/2008 Chen ..... 450/54
7,677,952 B2 * 3/2010 Wooley ..... 450/81
8,221,189 B2 * 7/2012 Chen et al. ..... 450/81
8,360,815 B2 * 1/2013 Cho ..... 450/39
8,371,902 B2 * 2/2013 Sherwood ..... 450/58

* cited by examiner

*Primary Examiner* — Gloria Hale
(74) *Attorney, Agent, or Firm* — Shimokaji & Associates P.C.

(57) ABSTRACT

An invisible bra has two breast boosting sections, two central concave openings and two wing sections. Each breast boosting section has an arcuate cross section, a convex top edge and a convex bottom edge. The central concave openings are respectively located below and above where the breast boosting sections are connected with each other. The wing sections are respectively and integrally connected with the breast boosting sections and are respectively located at two opposite sides of the invisible bra. Each wing section has a top section, a free side and a wrinkle-proof concave. The wrinkle-proof concaves can effectively reduce wrinkles and make the invisible bra well attached to the breasts.

14 Claims, 11 Drawing Sheets

INVISIBLE BRA

BACKGROUND OF THE INVENTION

1. Field of the Invention

The present invention relates to an invisible bra, and more particularly to an invisible bra effectively reducing wrinkles.

2. Description of Related Art

With reference to FIGS. 11 and 12, a conventional invisible bra 80 is a strapless, soft, elastic and flat pad. The pad has an adhesive inner surface to be attached to a lower section of breasts. Accordingly, the breasts can be boosted and form a deep bust line.

FIG. 13 refers to step 1, step 2, step 3 and step 4 of how to wear the conventional invisible bra 80.

Step 1: an inner surface of a left side 81 of the invisible bra 80 is attached to a left breast.

Step 2: a left hand lifts a right breast. A right side 82 of the invisible bra 80 is tightened along a rim of the right breast and adheres to and covers the right breast.

Step 3: a shape of the right breast is then adjusted. The inner surface of the left side 81 of the invisible bra 80 is detached off and step 2 is repeated. The right hand lifts the left breast. The left side 81 of the invisible bra 80 is tightened along a rim of the right breast and covers and adheres to the left breast.

Step 4: step 2 and step 3 are repeated until the invisible bra 80 adheres to and boosts the breasts.

However, the invisible bra 80 cannot ergonomically adhere to the rims of the breast very well. Consequently wrinkles easily occur. Moreover, the conventional invisible bra 80 is a flat pad and cannot fully cover the breasts. A top edge and a bottom edge of the invisible bra 80 are flat. When the invisible bra 80 is squeezed to cover the breasts, the breasts are pressed unevenly and this causes uncomforting feeling.

Besides, another invisible bra is single cup-shaped to cover a single breast. There is no structure for two conventional invisible bras to be connected with each other. Consequently, the conventional invisible bra lacks an effect of forming a bust line.

Another invisible bra, called "Nubra", is single cup-shaped to cover a single breast. Two Nubras are required to be connected with each other to make a bust line. However, a relative position between the single breast and the single Nubra cannot be further adjusted after the Nubra is attached. Consequently, the breasts cannot be further squeezed and an effect of forming a deep bust line is restricted.

To overcome the shortcomings, the present invention tends to provide an invisible bra to mitigate the aforementioned problems.

SUMMARY OF THE INVENTION

The main objective of the invention is to provide an invisible bra effectively reducing wrinkles.

An invisible bra has two breast boosting sections, two central concave openings and two wing sections. Each breast boosting section has an arcuate cross section, a convex top edge and a convex bottom edge. The central concave openings are respectively located below and above where the breast boosting sections are connected with each other. The wing sections are respectively and integrally connected with the breast boosting sections and are respectively located at two opposite sides of the invisible bra. Each wing section has a top section, a free side and a wrinkle-proof concave edge. The wrinkle-proof concave edges concavcs can effectively reduce wrinkles and make the invisible bra well attached to the breasts.

Other objects, advantages and novel features of the invention will become more apparent from the following detailed description when taken in conjunction with the accompanying drawings.

DETAILED DESCRIPTION OF PREFERRED EMBODIMENT

Figure 1:
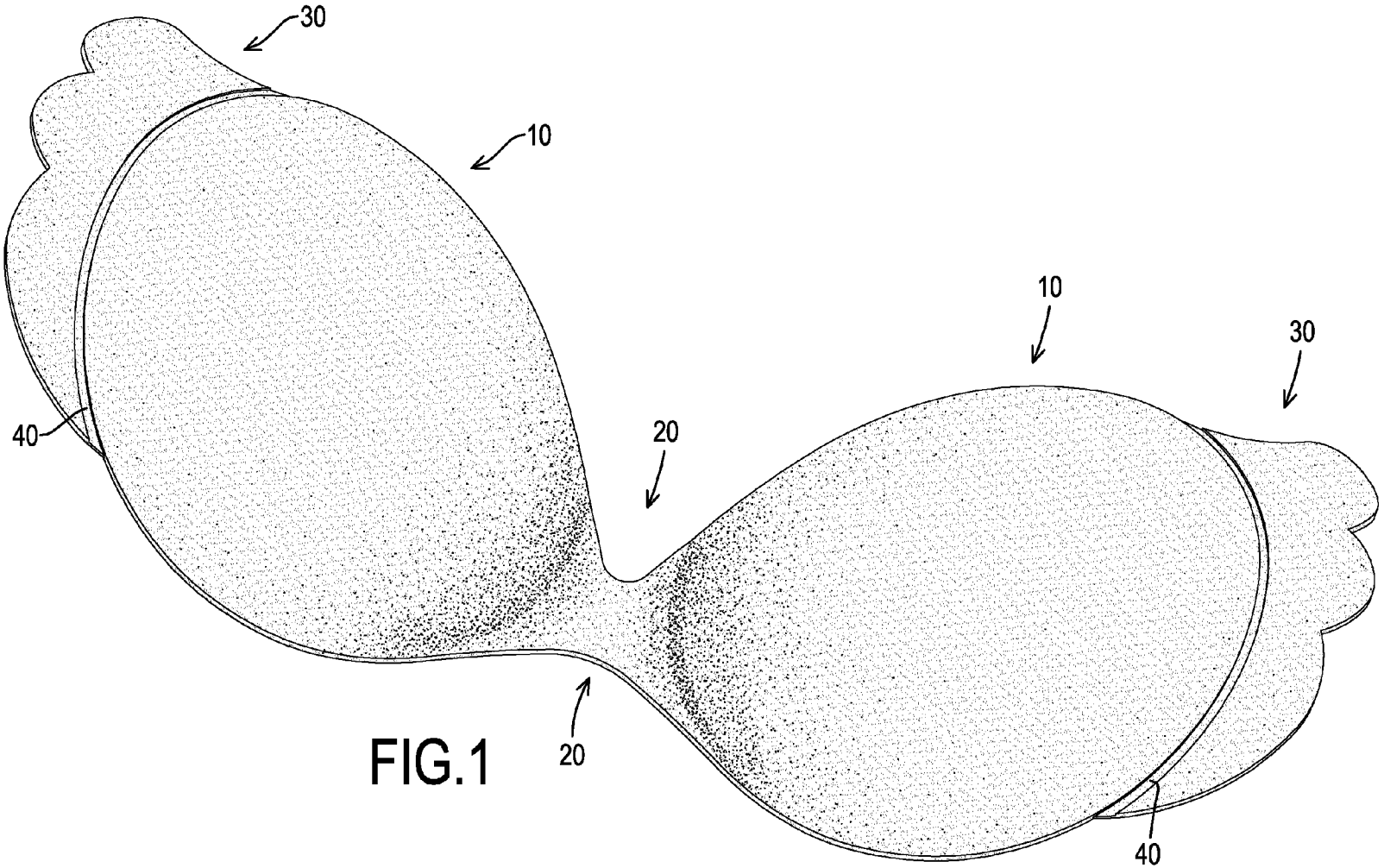
FIG. 1 is a perspective view of a first embodiment of an invisible bra in accordance with the present invention.
Figure 2:
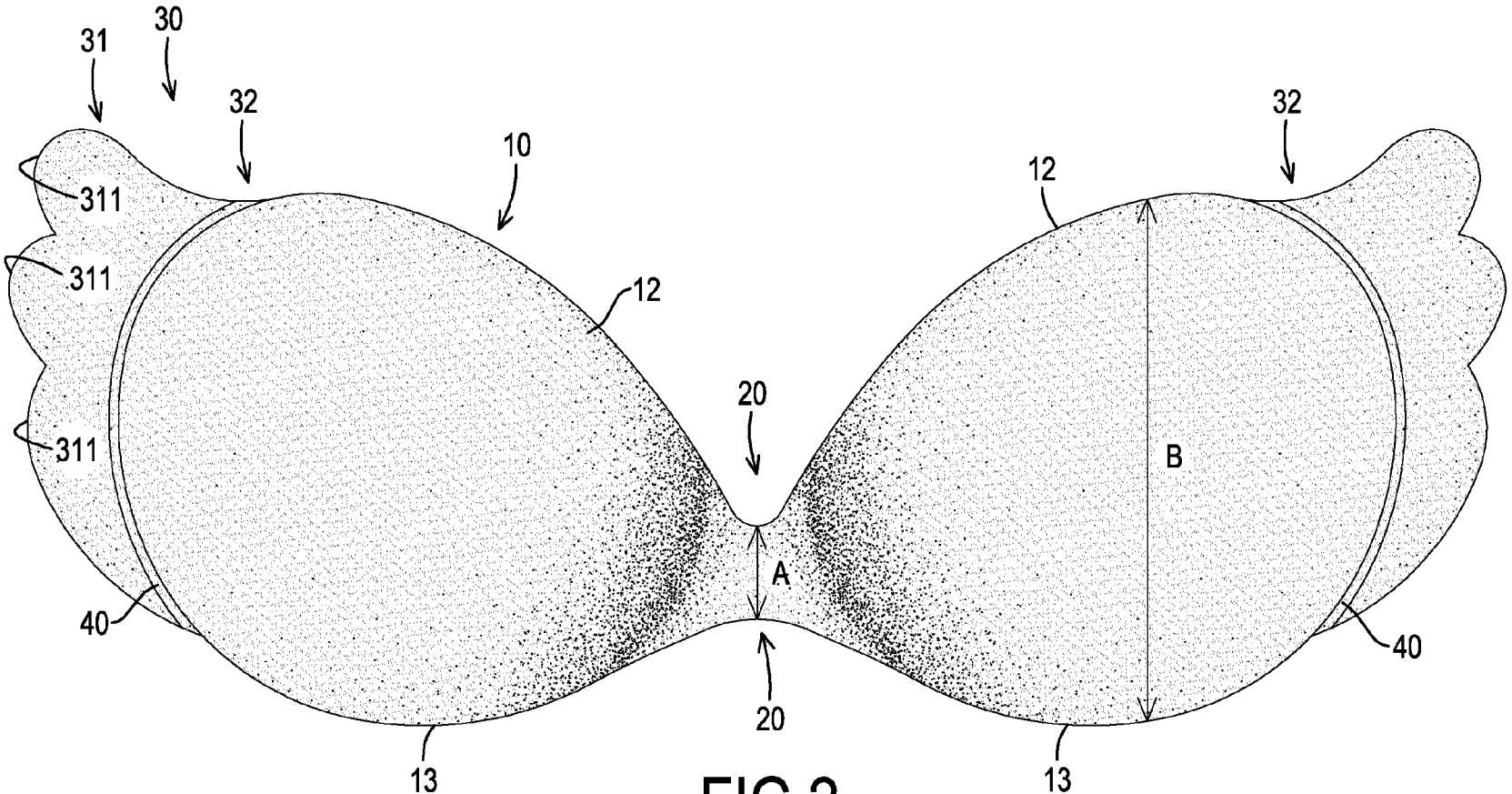
FIG. 2 is a front view of the invisible bra in FIG. 1.
Figure 3:
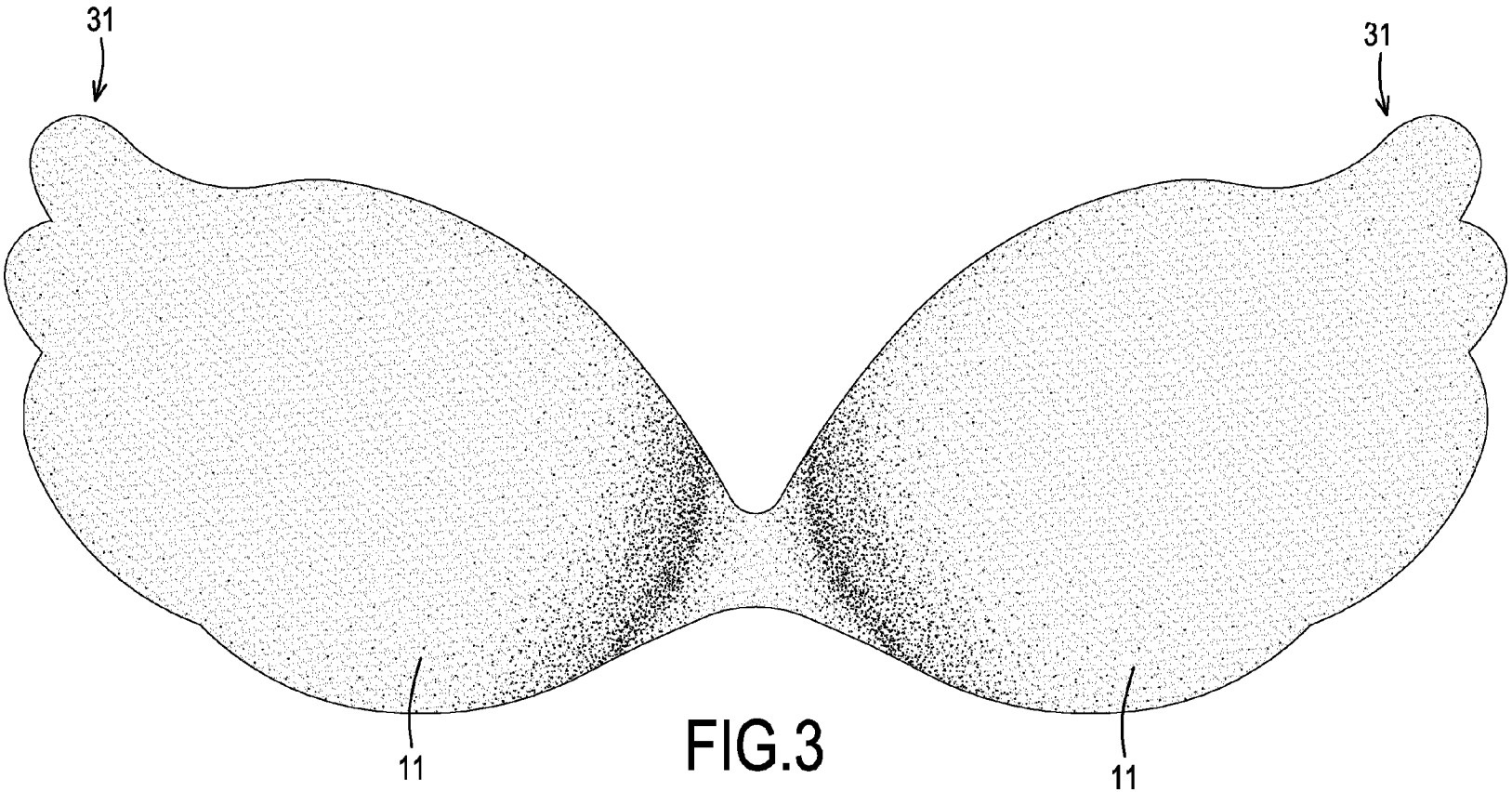
FIG. 3 is a rear view of the invisible bra in FIG. 1.
Figure 4:
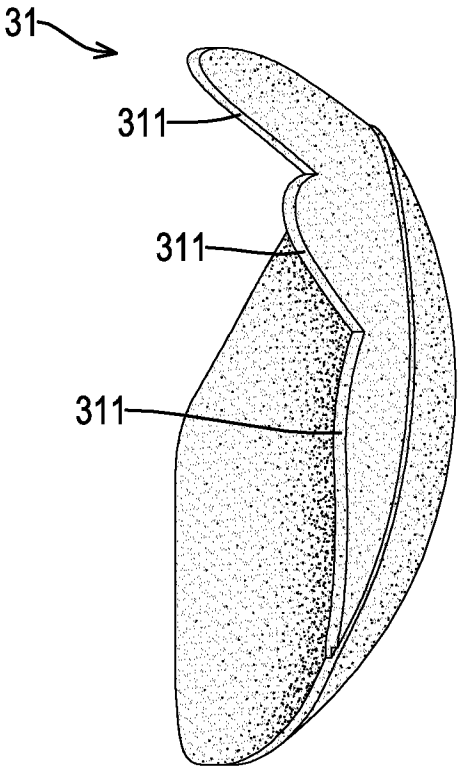
FIG. 4 is a side view of the invisible bra in FIG. 1.
Figure 5:
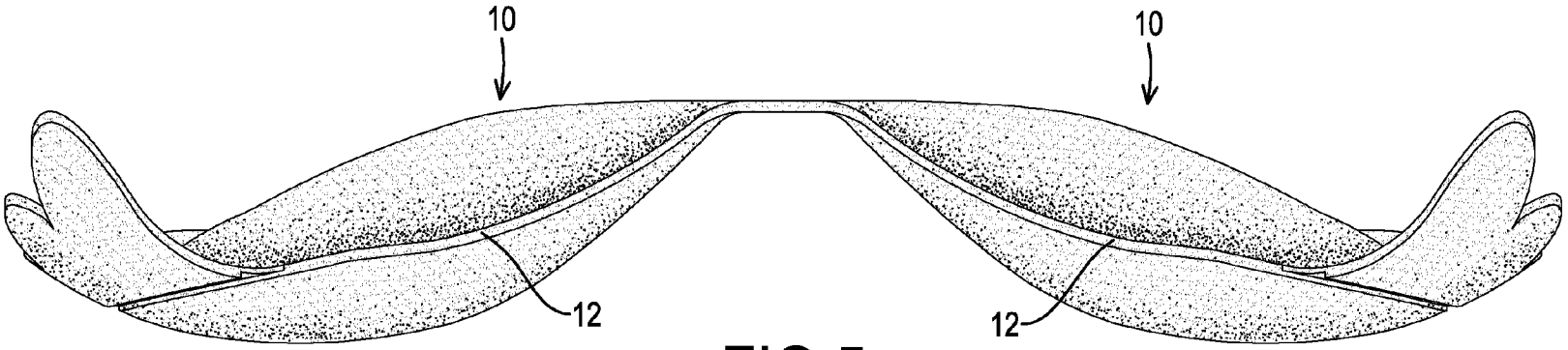
FIG. 5 is a top view of the invisible bra in FIG. 1.
Figure 6:
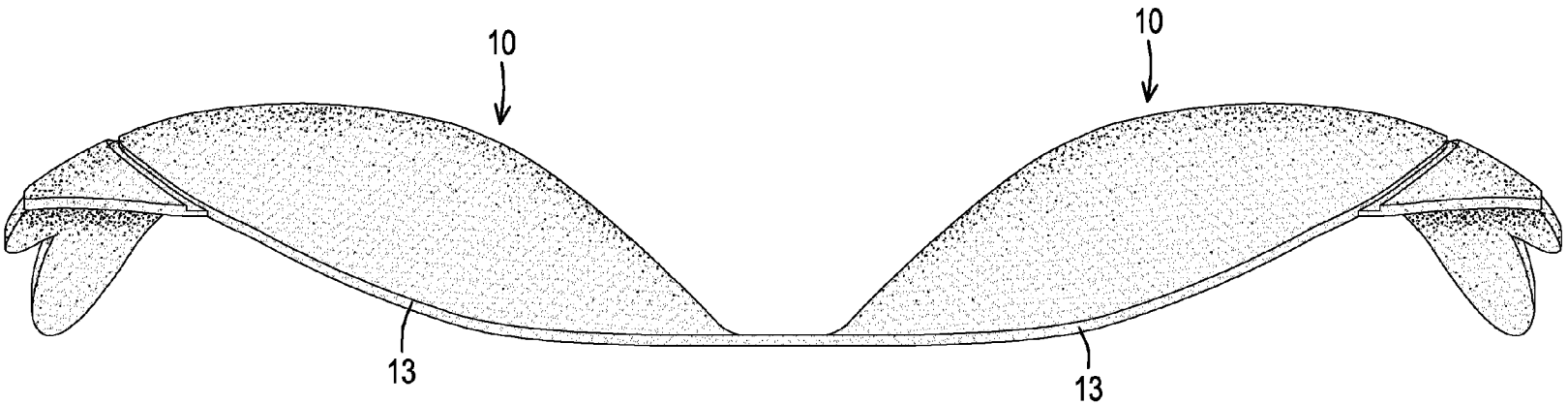
FIG. 6 is a bottom view of the invisible bra in FIG. 1.
Figure 7:
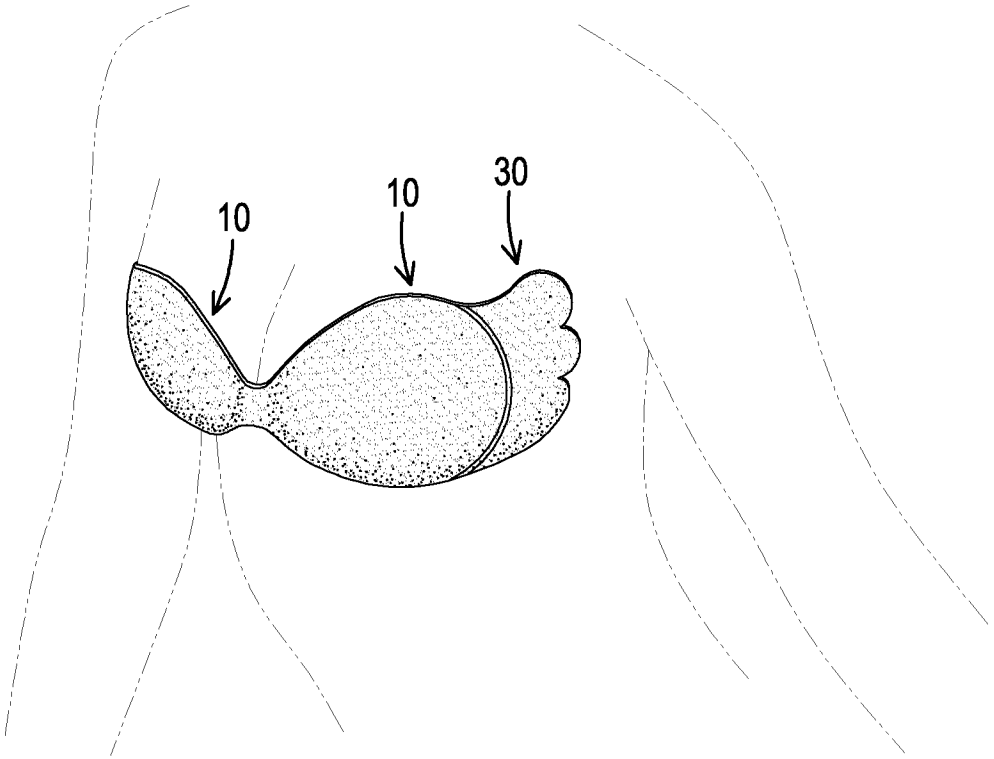
FIG. 7 is an operational view of the invisible bra in FIG. 1.

With reference to FIGS. 1 to 3, a first embodiment of an invisible bra in accordance with the present invention comprises two breast boosting sections 10, a first width A, a section width B, two central concave openings 20, two wing sections 30 and two grooves 40.

The breast boosting sections 10 are connected with each other. Each breast boosting section 10 has a cross section, an inner surface 11, a convex top edge 12 and a convex bottom edge 13. The cross section of each breast boosting section 10 is arcuate. The inner surface 11 of each breast boosting section 10 is adhesive.

The first width A is defined as a shortest longitudinal width of where the breast boosting sections 10 are connected with each other.

The second width B is defined as a longest longitudinal width of each breast boosting section 10. The first width A is shorter than half of the second width B.

The central concave openings 20 are respectively located below and above where the breast boosting sections 10 are connected with each other.

With the central concave openings 20 along with the convex top edges 12 and the bottom edges 13, each breast boosting section 10 has a substantial round cross section to fully cover the breast.

With reference to FIGS. 2 to 7, the wing sections 30 are respectively and integrally connected with the breast boosting sections 10 and are respectively located at two opposite sides of the invisible bra. Each wing section 30 has an inner surface, a top section, a free side 31 and a wrinkle-proof concave edge 32.

The inner surface of each wing section 30 is adhesive. Accordingly, each wing section 30 can be attached to a lower part and a rim of the breast.

The top section of each wing section 30 has a highest end higher than that of a top section of each boosting section 10. Accordingly, the wing sections 30 are located at an upper position relative to the breast boosting sections 10. Consequently, the wing sections 30 can further boost the breasts when the wing sections 30 are attached to the rims of the breasts.

The free sides 31 of the wing sections 30 are respectively located at the two opposite sides of the invisible bra. Each free side 31 has multiple arc-shaped perimeter edge areas 311 (referred to in general as arc areas 311). Preferably, each free side 31 of the first embodiment has three arc areas 311. With the arc areas 311, the invisible bra in accordance with the present invention is similar to wings and also looks like human's hands holding the breasts. The arc areas 311 also help reduce wrinkles when the wing sections 30 are pressed.

Each wrinkle-proof concave edge 32 is formed in the top section of the wing section 30 and is adjacent to a corresponding one of the breast boosting sections 10.

Because the wrinkle-proof concave edges 32 are adjacent to positions where the wing sections 30 are connected with the breast boosting sections 10 and are also located at positions where the invisible bra bends, the wrinkle-proof concave edges 32 can effectively reduce wrinkles and facilitate the invisible bra's being well attached to the breasts. Accessory breasts can be further pushed toward and covered by the wing sections 30, so accessory breasts are prevented from being exposed outside the invisible bra in accordance with the present invention.

With reference to FIGS. 1 and 2, the grooves 40 are arcuate, are formed in outer surfaces opposite to the inner surfaces 11 of the breast boosting sections 10, are respectively located at the two positions where the breast boosting sections 10 are connected with the wing sections 30 and extend respectively along rims of the breast boosting sections 10.

Because the grooves 40 are arcuate and extend along the rims of the breast boosting sections 10, each breast boosting section 10 is more like a round. With the grooves 40, the wing sections 30 are easily bent relative to the breast boosting sections 10 and are well attached to the breasts.

Figure 8:
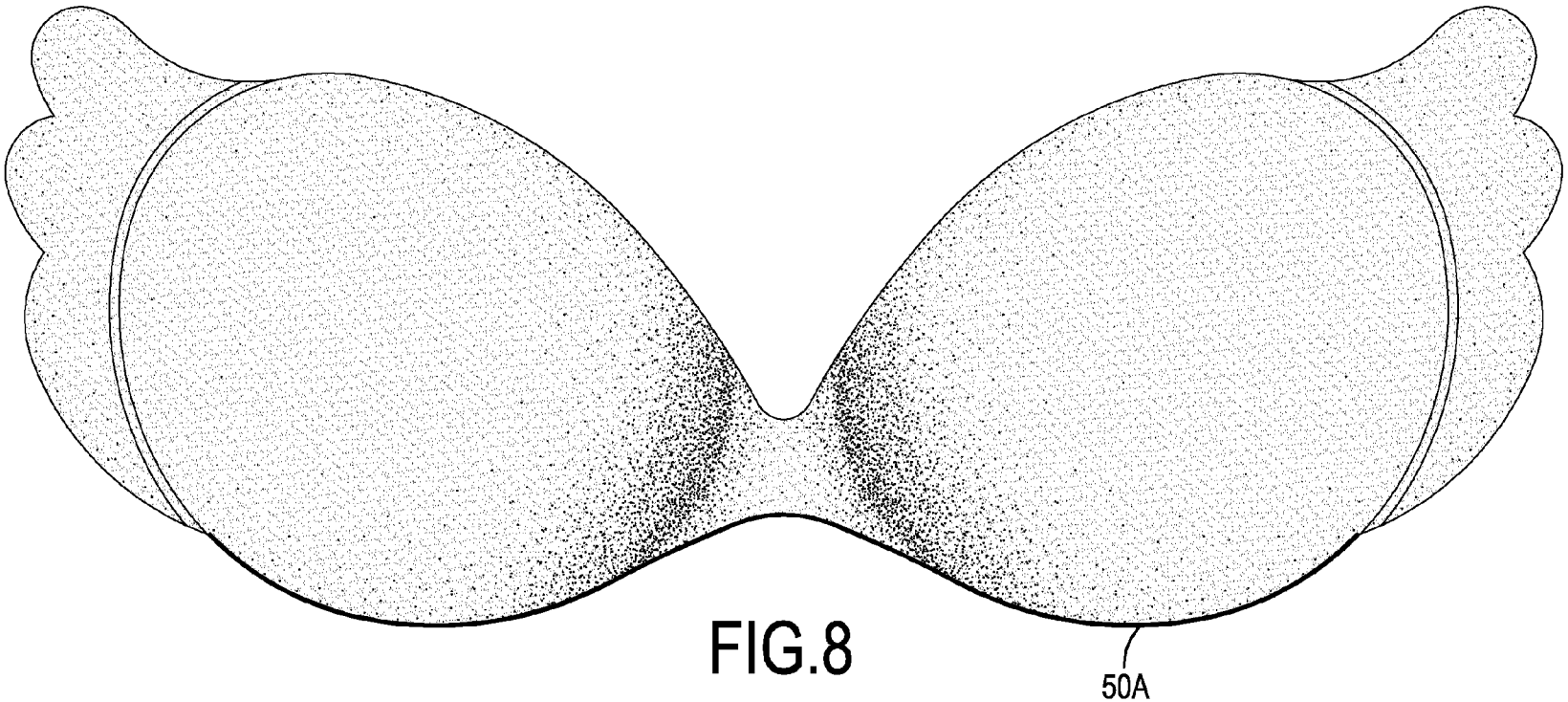
FIG. 8 is a front view of a second embodiment of the invisible bra in accordance with the present invention.

With reference to FIG. 8, a second embodiment is substantially the same as the first embodiment except a steel strip 50A is mounted securely on the bottom edges 13 of the breast boosting sections 10 to enhance a positioning effect.

Figure 9:
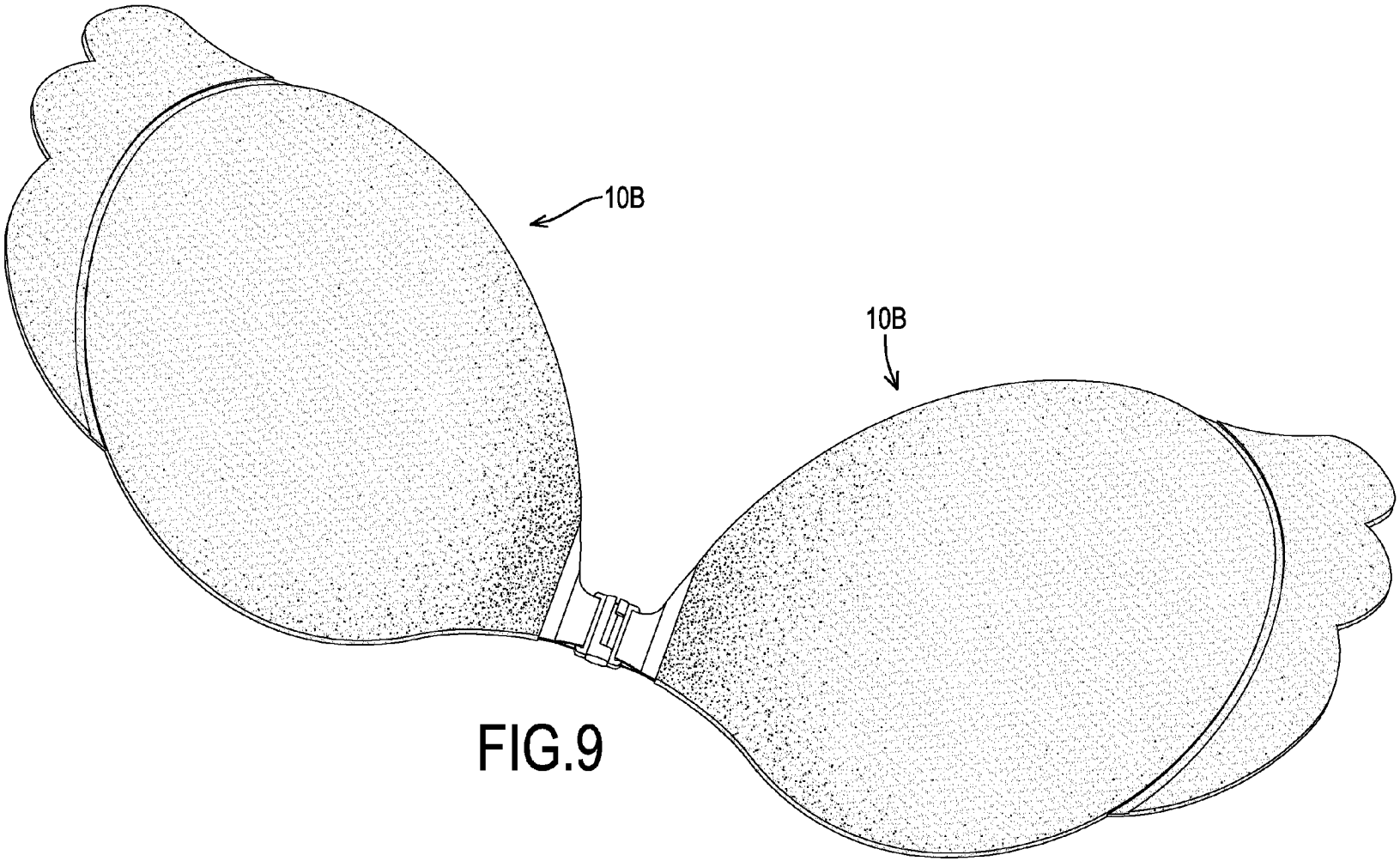
FIG. 9 is a perspective view of a third embodiment of the invisible bra in accordance with the present invention.

With reference to FIG. 9, a third embodiment is substantially the same as the first embodiment except the breast boosting sections 10B are detachably connected with each other.

Figure 10:
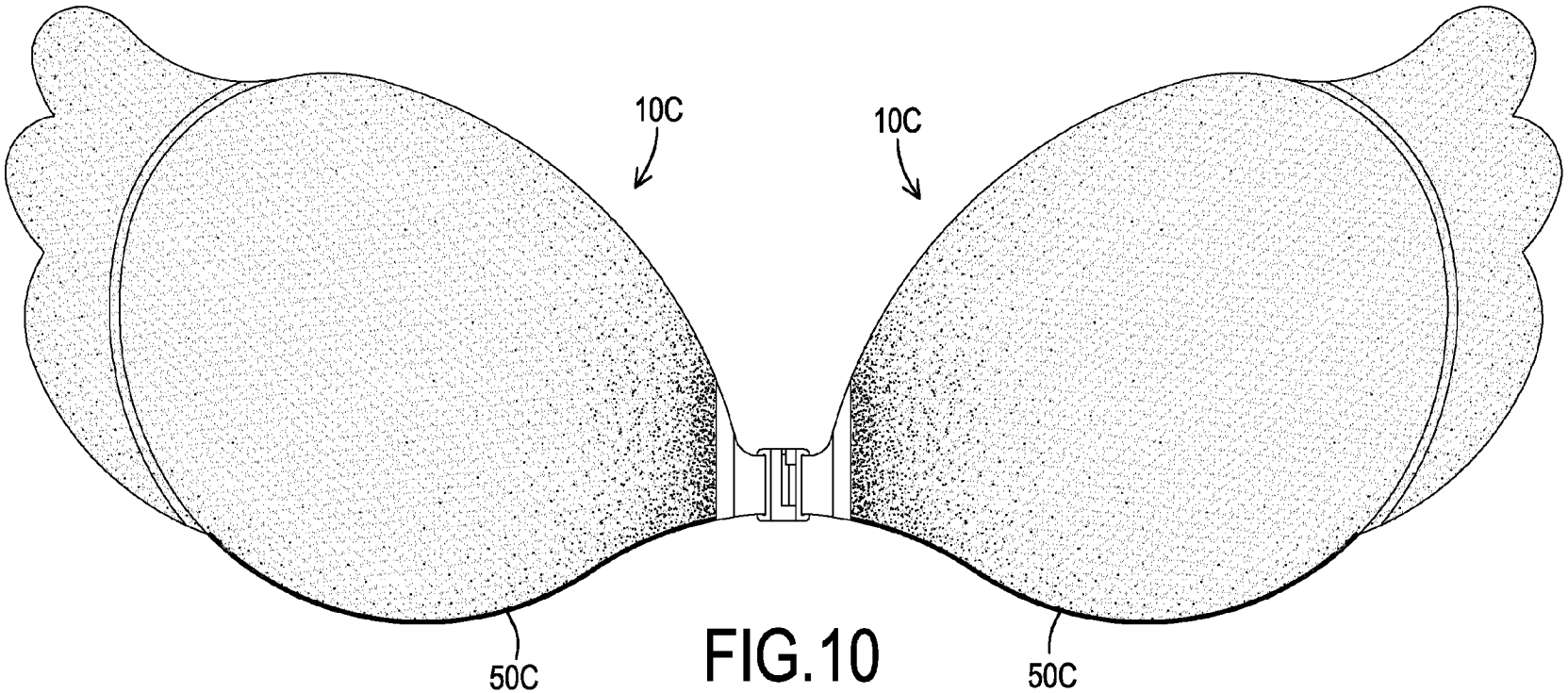
FIG. 10 is a front view of a fourth embodiment of the invisible bra in accordance with the present invention.
Figure 12:
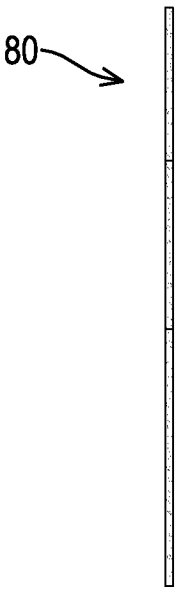
FIG.12 PRIOR ART
FIG. 12 is a side view of the conventional invisible bra in FIG. 11.
Figure 11:
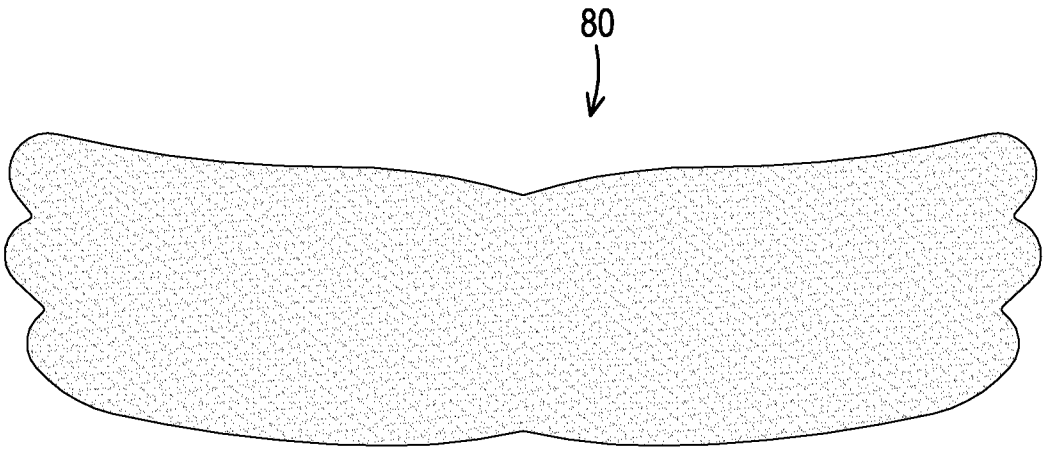
FIG.11 PRIOR ART
FIG. 11 is a front view of a conventional invisible bra in accordance with the prior art.
Figure 13:
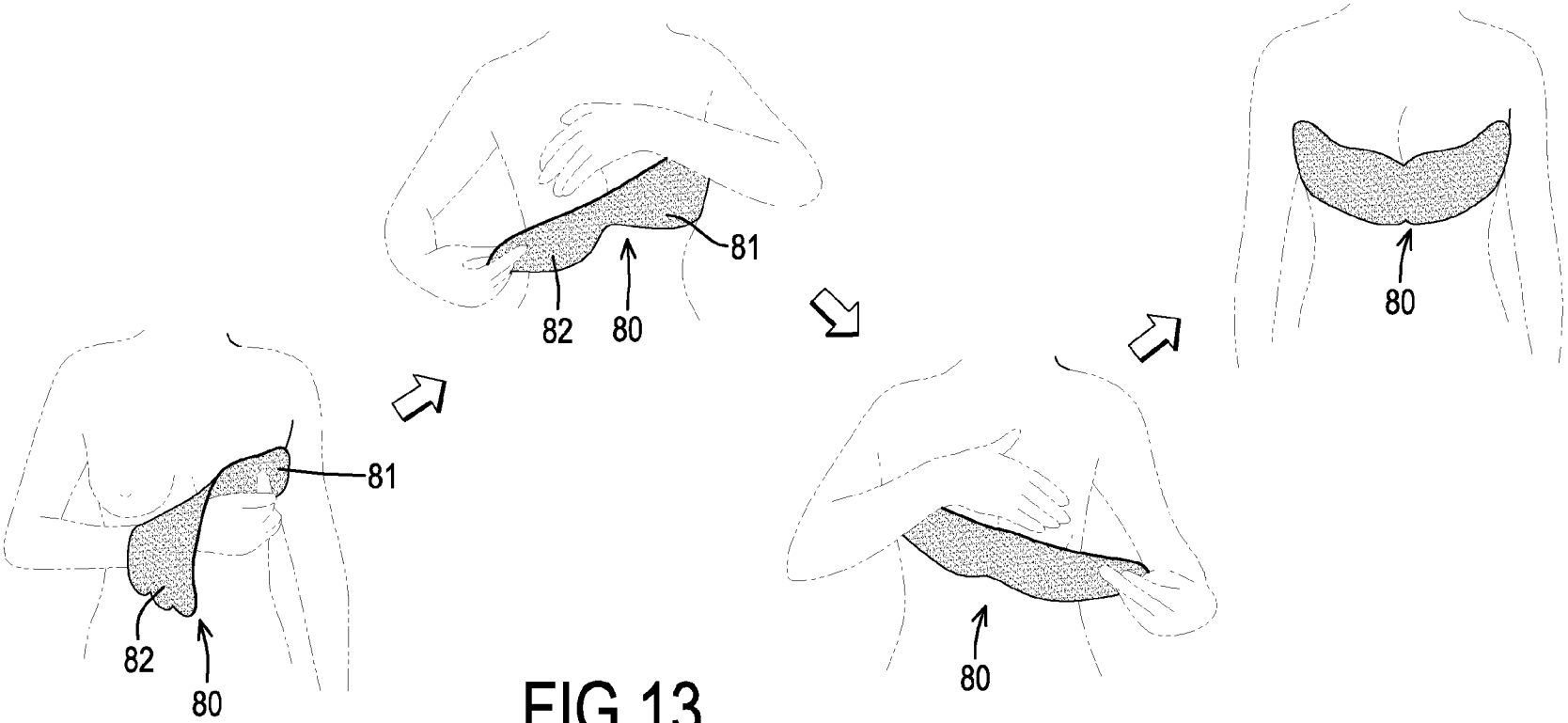
FIG.13 PRIOR ART
FIG. 13 is operational views of the conventional invisible bra in FIG. 12.

With reference to FIG. 10, a fourth embodiment is substantially the same as the third embodiment except two steel strips 50C are respectively and securely mounted on the bottom edges of the breast boosting sections 10C.

From the above description, it is noted that the present invention has the following advantages:

1. Effectively Reducing Wrinkles:

The wrinkle-proof concave edges 32 can effectively reduce wrinkles and make the invisible bra well attached to the breasts. Moreover, the arc areas 311 further help reduce wrinkles when the wing sections 30 are pressed.

2. Full Coverage and Convenient Adjustment:

Because of the central concave openings 20 as well as the convex top edges 12 and the bottom edges 13, each breast boosting section 10 has a substantial round cross section to fully cover the breast.

3. Good Boost:

The wing sections 30 are located at the upper position relative to the breast boosting sections 10, so the wing sections 30 can further boost the breasts when the wing sections 30 adhere to the rims of the breasts.

4. Convenient Adjustment and Concentration of the Breasts:

After attachment of the wing sections 30, a user can still adjust a relative position between the invisible bra and the breasts to further squeeze the breasts. Because the breast boosting sections 10 are connected with each other, the breasts are further squeezed to be concentrated and to form a deep bust line.

5. Excellent Attachment:

Because the grooves 40 extend along the rims of the breast boosting sections 10, the wing sections 30 are easily bent relative to the breast boosting sections 10 and adhere to the breasts tightly.

6. Reducing Accessory Breasts:

Accessory breasts can be further pushed toward and covered by the wing sections 30, so accessory breasts exposed outside the invisible bra are avoided.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A bra comprising:

two breast boosting sections connected with each other, each breast boosting section having an arcuate cross section;

an adhesive inner surface;

a convex top edge; and a convex bottom edge;

a connecting member between the breast boosting sections including two central concave openings at a top and bottom of the connecting member defining a first width of the connecting member, wherein each breast boosting section includes a second width between a top of the convex top edge and a bottom of the convex bottom edge, wherein the first width of the connecting member is shorter than half of the second width of each breast boosting section; and two wing sections respectively and integrally connected with the breast boosting sections and respectively located at two opposite sides of the bra, each wing section having:

an adhesive inner surface;

a top section having a highest end higher than that of a top section of each breast boosting section;

a free side having multiple arc areas, wherein the free side of respective wing sections are respectively located at the two opposite sides of the bra; and a wrinkle-proof concave edge formed in the top section of the wing section and adjacent to a corresponding one of the breast boosting sections.

2. The bra as claimed in claim 1, wherein the bra has an arcuate groove between respective breast boosting sections and respective wing sections formed in outer surfaces opposite to the inner surfaces of the breast boosting sections.

3. The bra as claimed in claim 2, wherein each wing section has three arc-shaped perimeter edges.

4. The bra as claimed in claim 3, wherein the bra is elastic.

5. The bra as claimed in claim 4, wherein a steel strip is mounted securely on the bottom edges of the breast boosting sections.

6. The bra as claimed in claim 1, wherein the breast boosting sections are integrally connected with each other.

7. The bra as claimed in claim 2, wherein the breast boosting sections are integrally connected with each other.

8. The bra as claimed in claim 3, wherein the breast boosting sections are integrally connected with each other.

9. The bra as claimed in claim 4, wherein the breast boosting sections are integrally connected with each other.

10. The bra as claimed in claim 5, wherein the breast boosting sections are integrally connected with each other.

11. The bra as claimed in claim 1, wherein the breast boosting sections are detachably connected with each other.

12. The bra as claimed in claim 2, wherein the breast boosting sections are detachably connected with each other.

13. The bra as claimed in claim 3, wherein the breast boosting sections are detachably connected with each other.

14. The bra as claimed in claim 4, wherein the breast boosting sections are detachably connected with each other.

* * * * *